United States Patent [19]

Stevenson, IV

[11] 4,365,572

[45] Dec. 28, 1982

[54] WORKING SAILS AND METHODS FOR FURLING THEM WHILE ALOFT

[76] Inventor: William H. Stevenson, IV, Travelers Rest, Rte. 5, Box 532, Easton, Md. 21601

[21] Appl. No.: 239,471

[22] Filed: Mar. 2, 1981

[51] Int. Cl.[3] ..... B63H 9/10

[52] U.S. Cl. ..... 114/104

[58] Field of Search ..... 114/102–105, 114/39

[56] References Cited

U.S. PATENT DOCUMENTS

| | | | |
|---|---|---|---|
| 2,247,219 | 6/1941 | Childs | 114/104 |
| 3,147,729 | 9/1964 | Barnard | 114/103 |
| 3,157,149 | 11/1964 | Manchester, Jr. | 114/104 |
| 3,269,343 | 8/1966 | Manchester, Jr. | 114/104 |
| 4,026,230 | 5/1977 | Wilford | 114/104 |
| 4,102,289 | 7/1978 | Ebbeson et al. | 114/104 |
| 4,122,793 | 10/1978 | Molz | 114/106 |

*Primary Examiner*—Trygve M. Blix
*Assistant Examiner*—Jesús D. Sotelo
*Attorney, Agent, or Firm*—Roylance, Abrams, Berdo & Farley

[57] ABSTRACT

Working sails are furled remotely while aloft by progressively forming flexible sheet material along the forepart of the sail into a tubular bag containing the sail furled from leech to luff in such fashion that, when furling and bagging of the sail has been completed the lines employed for furling are contained with the sail in the bag.

26 Claims, 19 Drawing Figures

WORKING SAILS AND METHODS FOR FURLING THEM WHILE ALOFT

This invention relates to working sails and to methods for furling them while aloft.

RELATED APPLICATION

The invention relates to improvements in sails and methods of the type disclosed in my copending application Ser. No. 139,105, filed Apr. 10, 1980, and the disclosure of that application is hereby incorporated herein by reference.

BACKGROUND OF THE INVENTION

Furling of working sails has historically been accomplished by direct manual manipulation of the sail, requiring that one or more of the crew go forward (in the case of a headsail) or at least out of the cockpit (in the case of a mainsail). Prior-art workers long sought improved sail systems and methods to overcome the disadvantages of manual furling, but until the invention disclosed in my aforementioned copending application, only the so-called "roller furling" method had achieved any substantial success, and roller furling has left much to be desired because of the high cost of the system, the need for relatively complicated hardware aside from the sail, and the fact that such systems are inappropriate for mainsails.

According to the method and sail system disclosed in my aforementioned application, working sails are furled aloft by providing flexible sheet material extending along the sail from head to foot, employing a travelling furler to at least preliminarily furl the sail from leech to luff, progressively forming the flexible sheet material into a tubular bag extending from head to foot and enclosing the furled sail, and progressively securing the bag against opening. In particularly advantageous embodiments of that invention, the sail is in a new form having a double luff, slide fastener tapes are secured along the two portions of the double luff, and the furler is moved from head to foot to furl the sail, form the tubular bag and close the slide fastener to secure the bag, the furler being moved downwardly, to furl, by pulling furling lines, and upwardly, to unfurl, by pulling an unfurling line, the furling and unfurling lines being outside of the bag when the sail has been furled and bagged. While the sail system and method has proved highly advantageous in actual use, two disadvantages have been encountered. The first disadvantage is the fact that hardware extraneous to the sail itself and in addition to that required simply to hoist and fly the sail must be provided. While the additional hardware is minimal, it still requires purchase outside of the sail loft and additional installation aloft. The second disadvantage is presence of the furling and unfurling lines outside of the tubular bag when the sail, having been furled and bagged, is left aloft. So disposed, the lines sometimes tend to flap in the wind and, when the bagged sail is lowered, must be either secured aloft (the travelling furler then being removed from the furled and bagged sail and remaining attached to the lines), or taken down and stowed. While these disadvantages are minor in comparison with those encountered with prior-art furling gear, they have still posed a need for improvement.

OBJECTS OF THE INVENTION

A primary object of the invention is to devise a sail system and method of the type referred to but which requires no hardware aloft which is not carried by the sail itself.

Another object is to provide such a sail system involving nothing which cannot be worked, and sold over the counter, in an ordinary sail loft.

A further object is to provide a sail system and method such that, after the sail has been furled and bagged by manipulation of the furling line or lines, all of the furling and unfurling lines will be contained within the tubular bag which encloses the sail, except for portions which run from the foot and can be detached and secured on deck.

Yet another object is to provide such a sail system in which no line need be connected directly to the runner of the separable fastener employed to secure the bag closed.

SUMMARY OF THE INVENTION

According to the invention, the ends of the furling line or lines and the unfurling line most distant from the furler are connected together, the furling line or lines are pulled downwardly outside of the space between the two luff portions to accomplish furling, and the unfurling line is concurrently pulled upwardly within the space between the two luff portions and adjacent the leading edge of the sail, and then downwardly along a path adjacent the fastener means which secures the bag closed, such movement of the unfurling line in turn causing the furling line or lines to be pulled upwardly within the space between the two luff portions. The unfurling line exits the sail at the foot. In the case of a headsail, that line is trained over a sheave or block secured directly to the sail and from the sheave extends along the deck to, e.g., the cockpit, the furling line means extending beneath a sheave or block secured to the deck and being extended along the deck for connection to the unfurline line. At the head of the sail, a sheave or block is secured directly to the sail, and when the sail is unfurled, the unfurling line extends over this upper sheave and is attached directly to the furler. In the case of a mainsail, the deck sheave or sheaves used for headsails are advantageously replaced by one double sheave secured directly to the mast below the boom.

IDENTIFICATION OF THE DRAWINGS

In order that the invention can be understood in detail, particularly advantageous embodiments thereof will be described with reference to the accompanying drawings, wherein.

Figure 8:
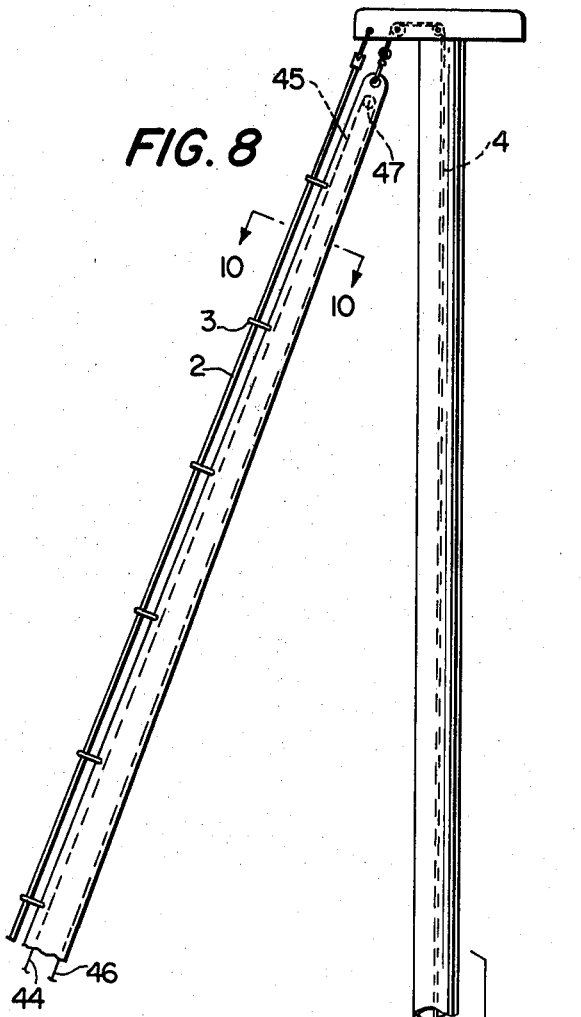
FIG. 8 is a view similar to FIG. 1 but showing the sail furled and bagged.
Figure 8:
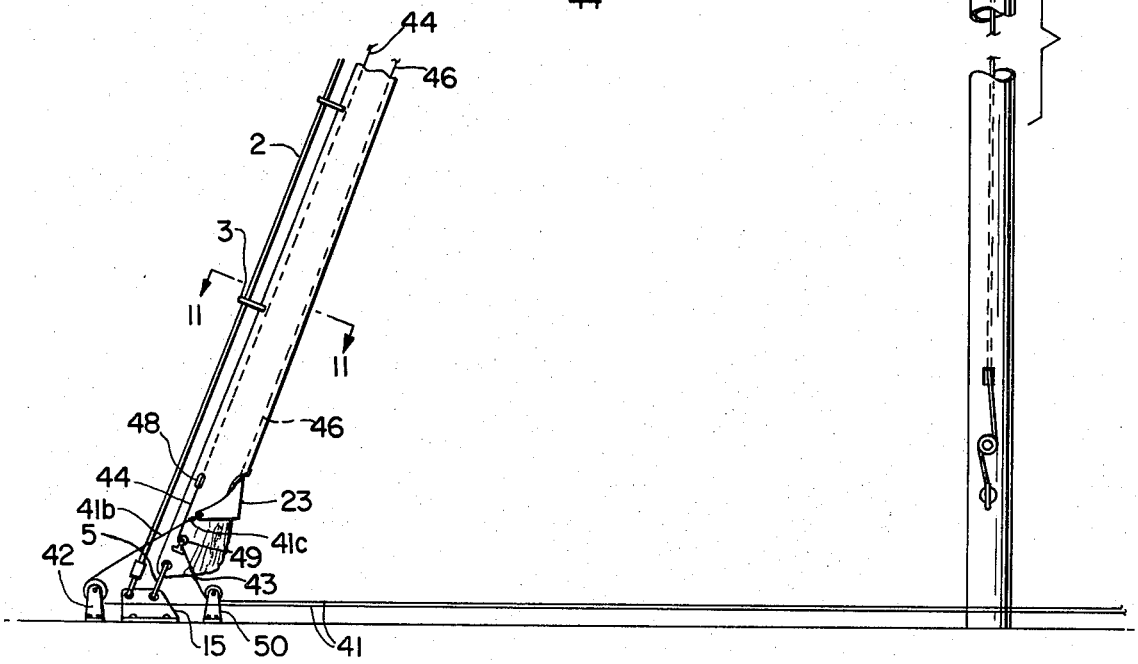
Figure 10:
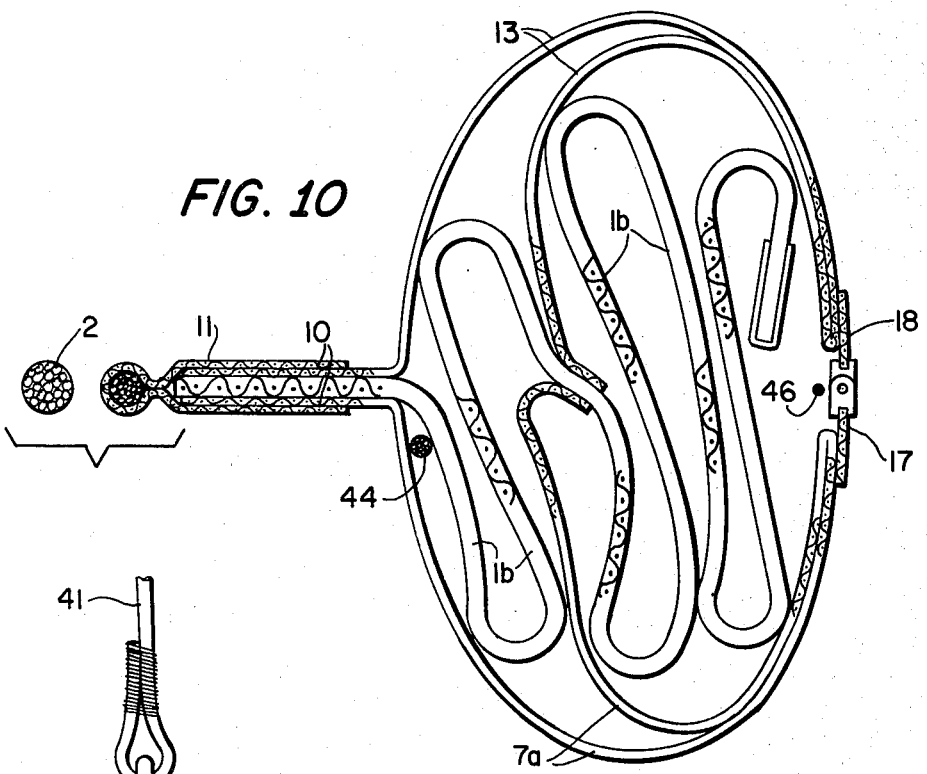
Figure 12:
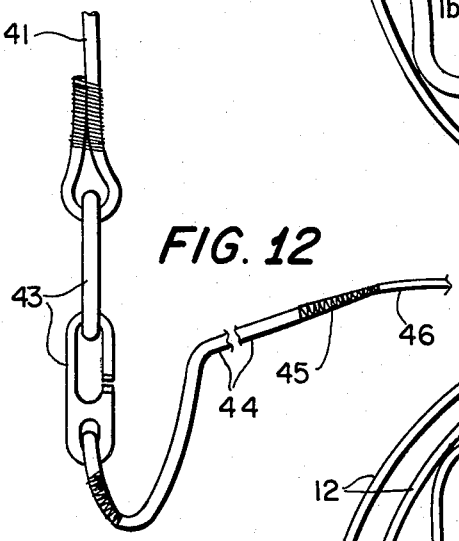
Figure 11:
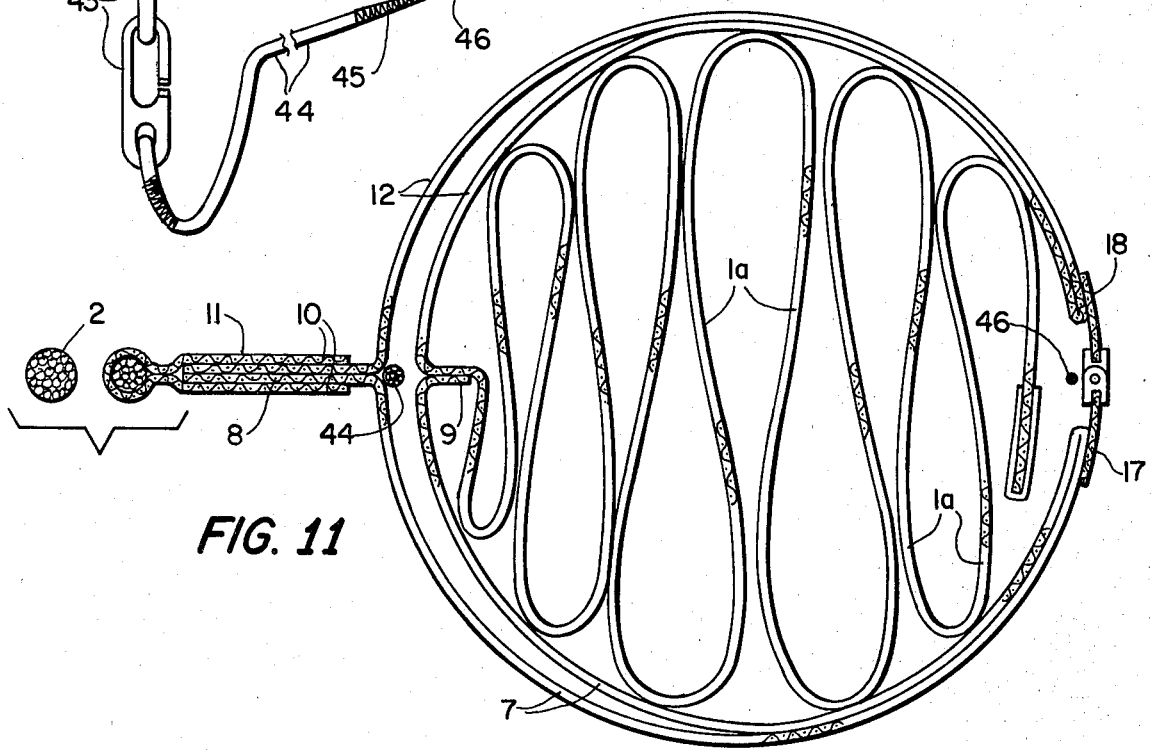
Figure 16:
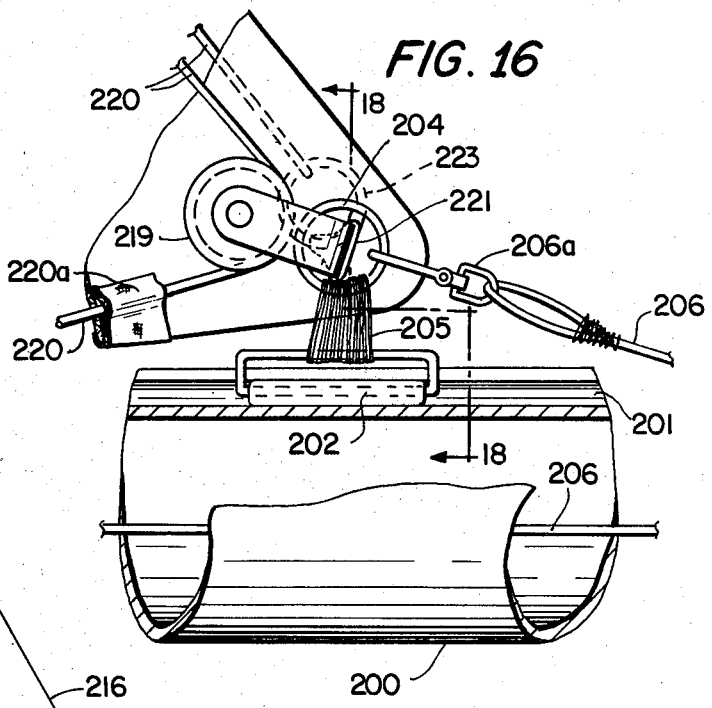
Figure 13:
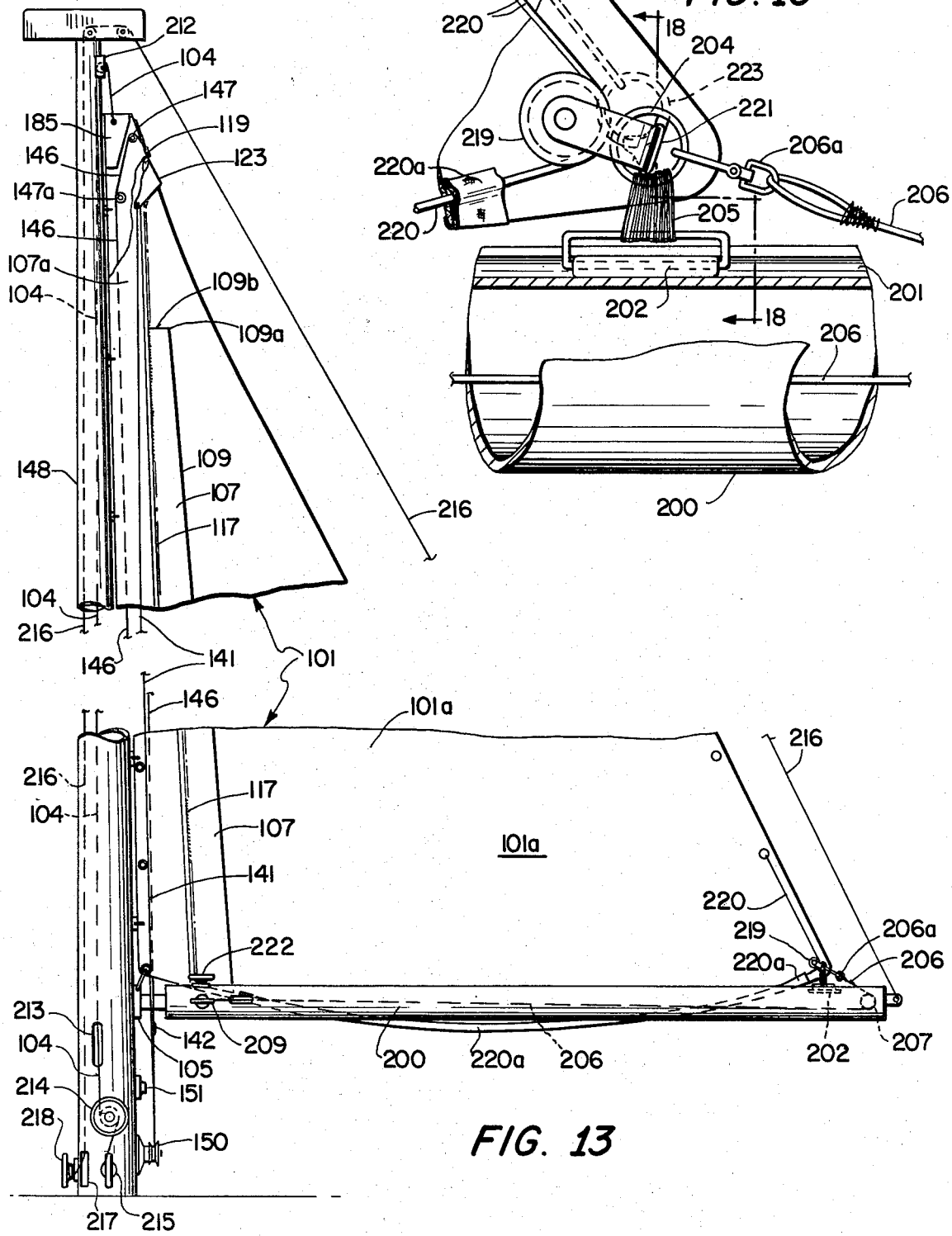
Figures 14, 19:
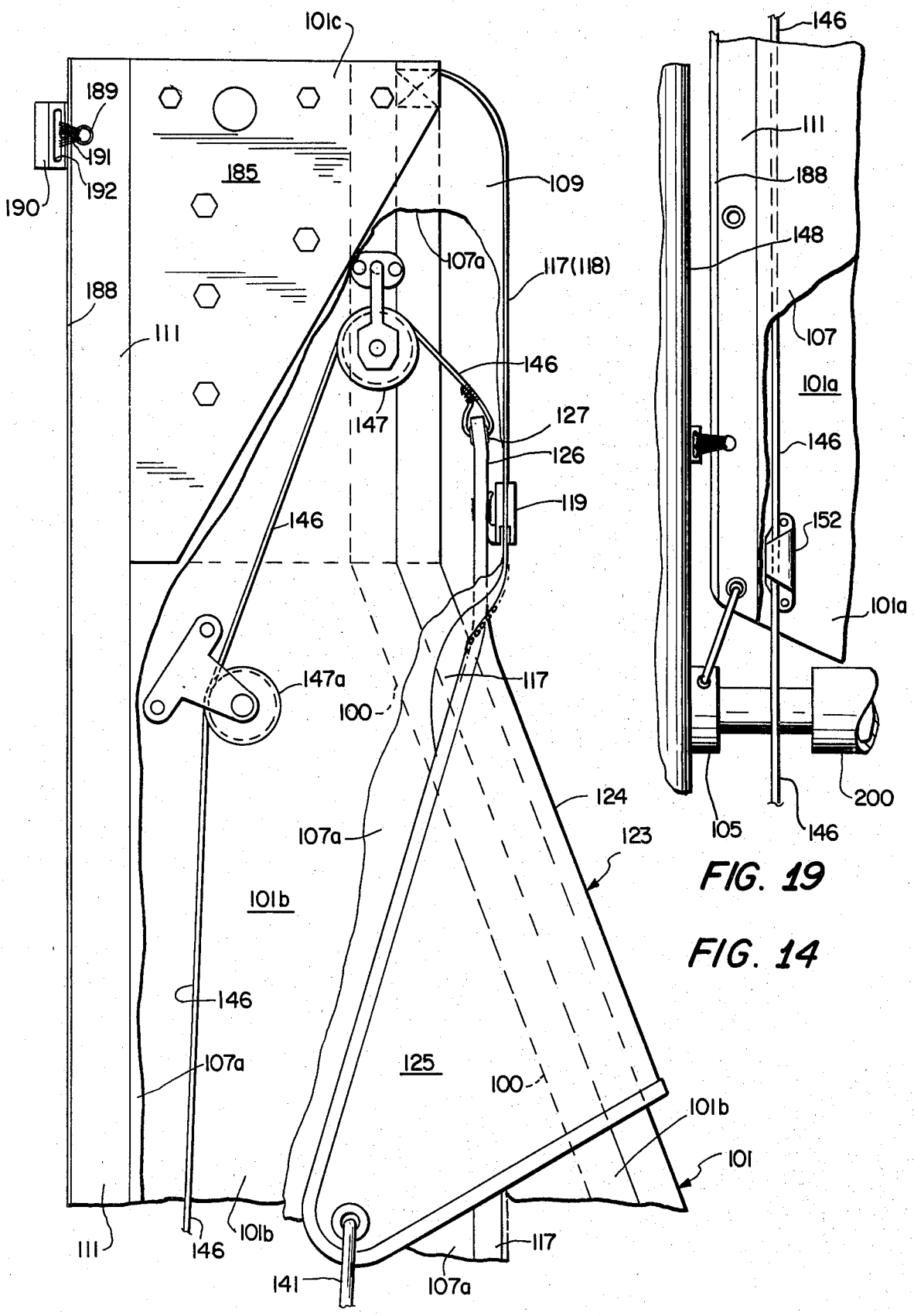
Figure 15:
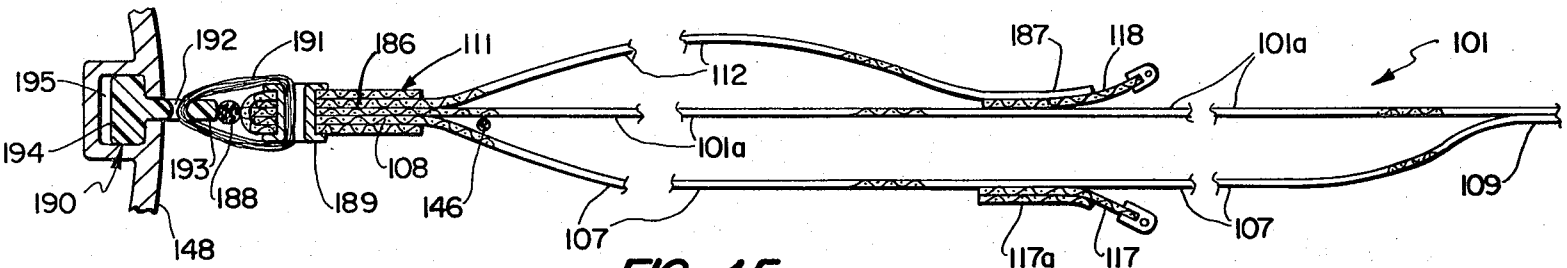
Figure 17:
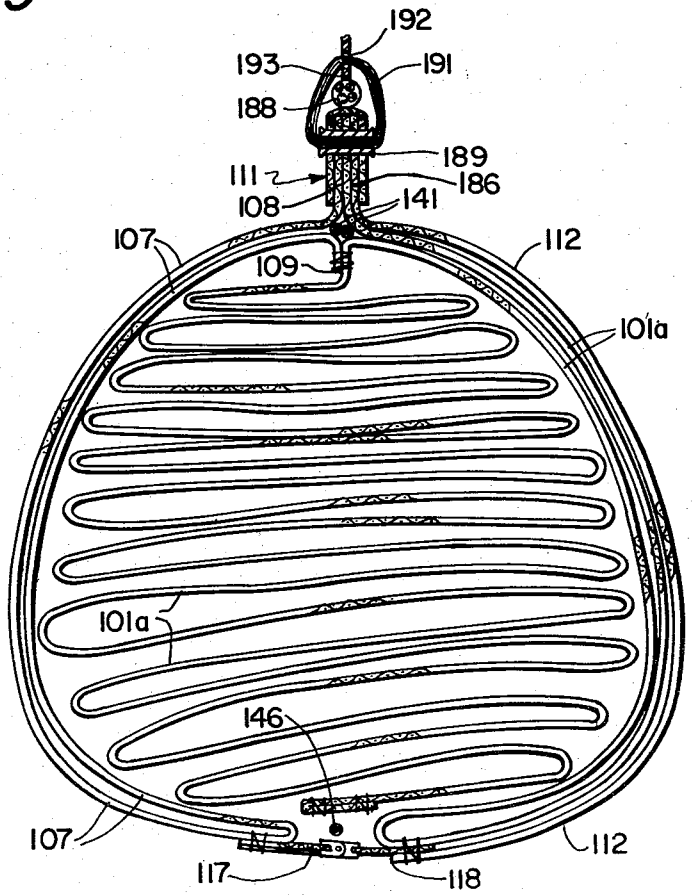
Figure 18:
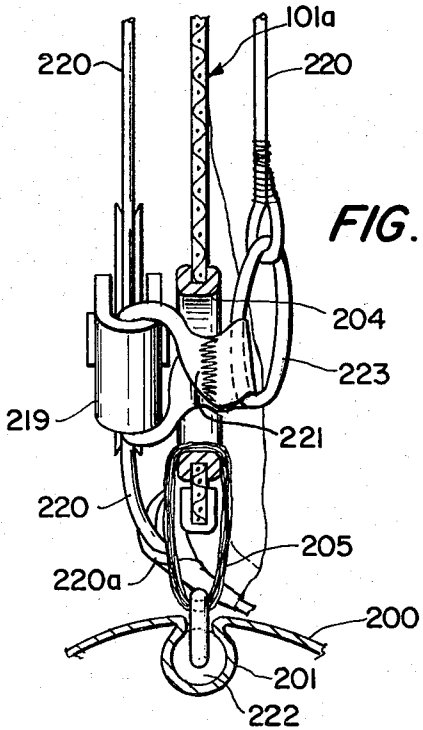

FIGS. 10 and 11 are semidiagrammatic transverse sectional views taken generally on lines 10—10 and 11—11, respectively, FIG. 8;

FIG. 12 is a fragmentary elevational view showing a portion of line means employed with the sail of FIGS. 1-11;

FIG. 13 is a semidiagrammatic side elevational view of a mainsail according to another embodiment of the invention;

FIG. 14 is an enlarged fragmentary side elevational view of the head portion of the sail of FIG. 13 with the furler in its uppermost position and with parts broken away for clarity of illustration;

FIG. 15 is a semidiagrammatic fragmentary horizontal sectional view taken below the head portion of the sail of FIG. 13;

FIG. 16 is an enlarged fragmentary side elevational view of structure at the clew of the sail of FIG. 13;

FIG. 17 is a semidiagrammatic transverse sectional view of the sail of FIG. 13 after being furled and bagged;

FIG. 18 is a fragmentary sectional view taken generally on line 18—18, FIG. 16; and FIG. 19 is a fragmentary side elevational view of a portion of the sail of FIG. 13 at the tack with part of one luff portion broken away for clarity of illustration.

DETAIL DESCRIPTION OF THE SAIL SYSTEM OF FIGS. 1-12

FIGS. 1-12 illustrate the invention as applied to a jibsail 1 connected to headstay 2 by conventional clip-on hanks 3 and equipped with a halyard 4, a tack cringle secured to tack hook 5, and sheets 6. The sail can be of any sail cloth suitable for a working sail and is advantageously of a fabric woven from polyethylene terephthalate fiber (e.g., that marketed as DACRON by E. I. du Pont de Nemours & Co., Wilmington, Del.), and includes a main sail body, indicated generally at 1*a*, and a reinforced head area, indicated at 1*b*. Main body 1*a* is in the form of a single sheet of fabric made up of a plurality of panels as shown, the panels being cut and sewed, with conventional broad seam tapering, to provide the substantial draft, i.e., chamber or transverse curvature, when the sail is set and flying, required for optimum sail performance. Reinforced head area 1*b* is also of conventional form, made up of a plurality of panels with the panels being of multiple sheets of fabric varying progressively from a larger number of sheets for the uppermost panel to a smaller number of sheets for the lowermost panel of the head area. Thus, head area 1*b* is substantially stiffer than the main body 1*a* with the increased stiffness being maximum at the uppermost panel and minimum at the lowermost panel of the head area.

Figure 4:
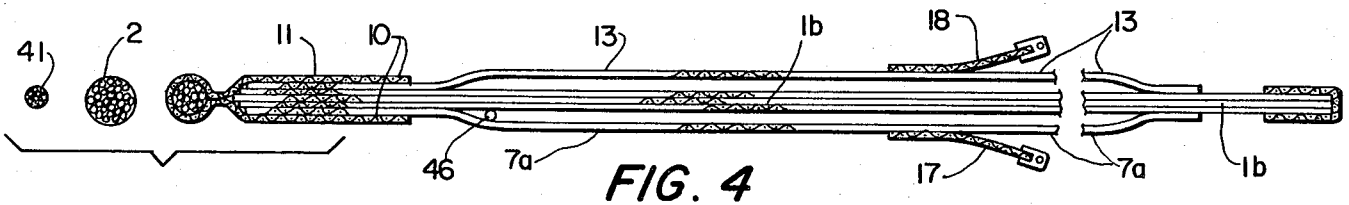
FIG. 4 is a semidiagrammatic horizontal sectional view taken through the head portion of the sail of FIG. 1.
Figure 5:
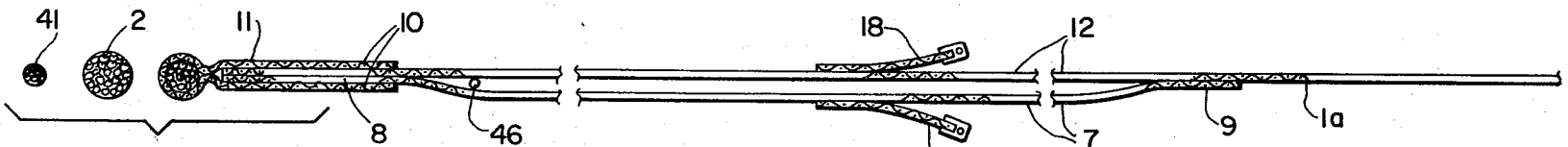
FIG. 5 is a semidiagrammatic fragmentary horizontal sectional view taken below the head portion of the sail.

Sail 1 is of the double luff type described in my copending application Ser. No. 139,105 and includes an additional portion 7, FIGS. 1-3, made up of an elongated portion of flexible sheet material, typically a fabric woven of, e.g., polyethylene terephthalate, nylon or acrylic cover cloth fibers and having a weight of 0.5-13 oz. per square yard, depending upon the particular sail. Added portion 7 extends completely from the head of the sail to the foot of the sail on one side only (the port side in this embodiment) and has a leading edge 8, which overlies and is secured to the leading edge of sail body 1*a* and reinforced head area 1*b* as seen in FIGS. 4 and 5, and a trailing edge 9 which extends over and is secured to the sail along a line spaced aft of the leading edge of the sail. Between leading edge 8 and trailing edge 9, added portion 7 is free and unattached, both with respect to the main body of the sail and with respect to the head area, and lies normally against the sail, separation between portions 1*a* and 7 and portions 1*b* and 7 being exaggerated in the drawings for clarity. Securing leading edge 8 to the leading edge of the sail and the reinforced head area is advantageously accomplished by having the leading edges of both the sail and portion 7 disposed within the two plies 10 of the conventional boltrope-equipped luff tape 11 and stitching through the luff type with heavy duty polyethylene terephthalate thread. The trailing edge of added portion 7 is simply sewed to the sail. Trailing edge 9 of added portion 7 slants at a small angle downwardly and aft so that portion 7 overlies that triangular portion of main sail body 1*a* which is immediately aft of the leading edge of the sail. The head end of added portion 7 extends upwardly over the leading portion of head area 1*b*, trailing edge 9 of portion 7 being parallel to the leading edge of head area 1*b*, and the upper end of portion 7 extending across and being stitched to the leech of the head area.

Commencing at the foot of head area 1*b* and going downwardly, the seam between the trailing edge 9 of added portion 7 and the main body of the sail, together with the seam along luff tape 11, define a forward portion 12 of the sail which has the same dimensions and shape as that part of portion 7 below the head area. Below reinforced head area 1*b*, sail portion 12 is fully exposed, no sheet material being added on the starboard side of the sail. Over head area 1*b*, however, this side also carries an additional portion 13 of flexible sheet material, as seen in FIG. 4, portion 13 being complementary to, and corresponding in size and shape to, the upper end portion of added portion 7. The leading edge of portion 13 is secured by stitching between one ply 10 of the luff tape and the starboard surface of the leading edge of the head area. The trailing edge of portion 13 is stitched directly to the head area. Portion 13 extends across the leech of the head area and is stitched thereto. Save for its leading and trailing edges and for being stitched to the leech, portion 13, like portion 7, simply overlies head area 1*b* and is not attached thereto.

The sail is equipped with a separable fastener comprising two elongated flexible fastener elements 17 and 18 and a runner 19. Element 17 extends from the head of the sail to the foot along the outer surface of added fabric portion 7 and is secured to that portion throughout its length, as by stitching. Element 18 extends from the head of the sail, first along added fabric portion 13, then along the starboard surface of sail portion 12, to the foot and is attached, as by stitching, to the underlying sail portions. Both elements 17 and 18 cross the leech of reinforced head area 1*b*, the head end portions of elements 17 and 18 being closed at the leech and secured there, in closed condition, to the respective ends of portions 7, 13 and the underlying leech. Thus, the separable fastener is maintained permanently closed at its extreme upper end.

In this embodiment, fastener elements 17 and 18 are opposite each other, through the thickness of the sail material and added fabric portions therebetween, throughout their length and therefore extend along mutually parallel lines (when the sail is set) which first curve from the leech to become parallel with the leading edge of the reinforced head area 1*b*, then remain parallel to that leading edge throughout the length of the head area 1*b*, and then slant downwardly and aft at a small angle away from the leading edge of the sail. Save for their permanently closed upper ends, fastener elements 17, 18 are (when the sail is set) spaced aft of the leading edge of the sail by a distance which is slightly more then 50% of the fore-to-aft seam-to-seam dimension of added fabric portion 7. The separable fastener can be of any conventional type capable of being progressively closed by moving runner 19 downwardly along elements 17, 18 and progressively opened by movement of the runner upwardly along the fastener elements. It is particularly advantageous to employ as the separable fastener a heavy duty conventional slide fastener of the type commonly referred to as a zipper since such fasteners are characterized by having, as elements 17 and 18, fabric tapes equipped with teeth along one edge of the tape and such tapes can be readily and securely sewed to fabric portion 7, sail body 1 and fabric portion 13.

Figure 7:
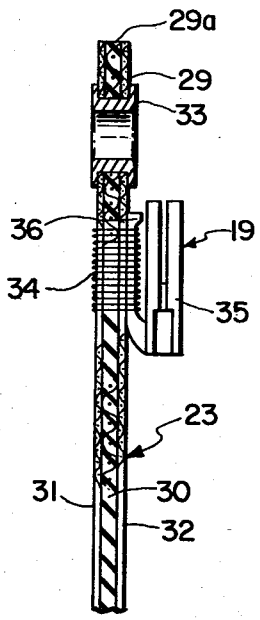
FIG. 7 is an enlarged fragmentary sectional view taken generally on line 7—7, FIG. 6.
Figure 6:
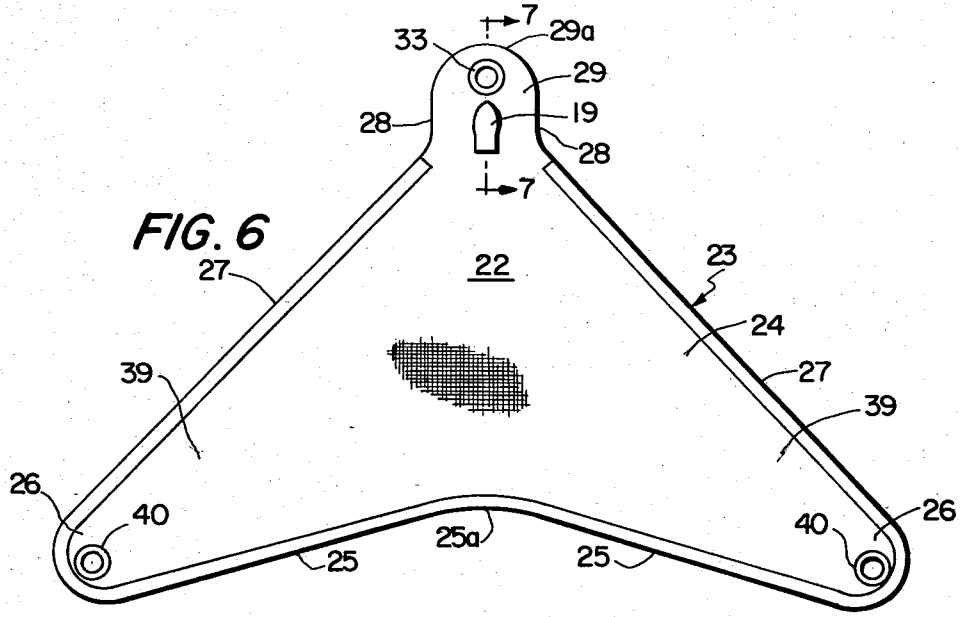
FIG. 6 is a plan view of a travelling furler employed with the sail of FIG. 1.

Runner 1 of the separable fastener is secured to the intermediate portion 22 of a travelling furler 23, FIGS. 6 and 7. The furler is in the form of a flexible laminated body 24 which is generally triangular in plan form when flattened as seen in FIG. 6. Body 24 has straight leading edges 25 joined at their adjacent edges by a curved portion 25*a*, edges 25 diverging outwardly at, e.g., 160° to rounded tip portions 26. Two straight trailing edges 27 of equal length slant rearwardly from the respective tip portions 26 to join the side edges 28 of a nose portion 29 which forms a continuation of intermediate portion 22 and projects rearwardly of the furler to terminate in a rounded edge 29*a*. Furler 23 can be made up of an intermediate ply 30, FIG. 7, of relatively thick and heavy fabric, an inner surface ply 31 and an outer surface ply 32, the inner surface ply being at least smooth and nonabrasive and at best of a material characterized by inherent lubricity. The plies are stitched together along the marginal portions of the body and advantageously along lines extending across the main body from the leading edges rearwardly, edges 25, 25*a* and 27 and tip portions 26 being bound with low friction tape stitched to the marginal portions as seen in FIG. 6. Edges 25 and 27 and tip portions 26 define two elongated generally triangular arms 39 each equipped at its tip with a cringle 40. The plies of body 24 are so dimensioned and stitched that the furler assumes a natural configuration of generally U-shape with arms 39 forming the legs of the U and intermediate portion 22 constituting the base of the U.

Nose portion 29 is equipped with a cringle 33 which is located immediately adjacent the rounded trailing edge 29*a* and centered on the longitudinal axis of portion 22. Runner 19 is secured, as by binding 34, FIG. 7, in a location centered on the longitudinal axis of portion 22 immediately ahead of cringle 33, so that runner 19 is actually carried by nose portion 29 in a location slightly rearwardly of the adjacent ends of edges 27. The fastener runner is of conventional type, advantageously of stainless steel, and includes a main body 35, which defines the passages to receive and close the toothed edges of the fastener elements 17 and 18, and a mounting arm 36 which extends beneath body 35 and cooperates with binding 34.

Figures 1, 2, 3:
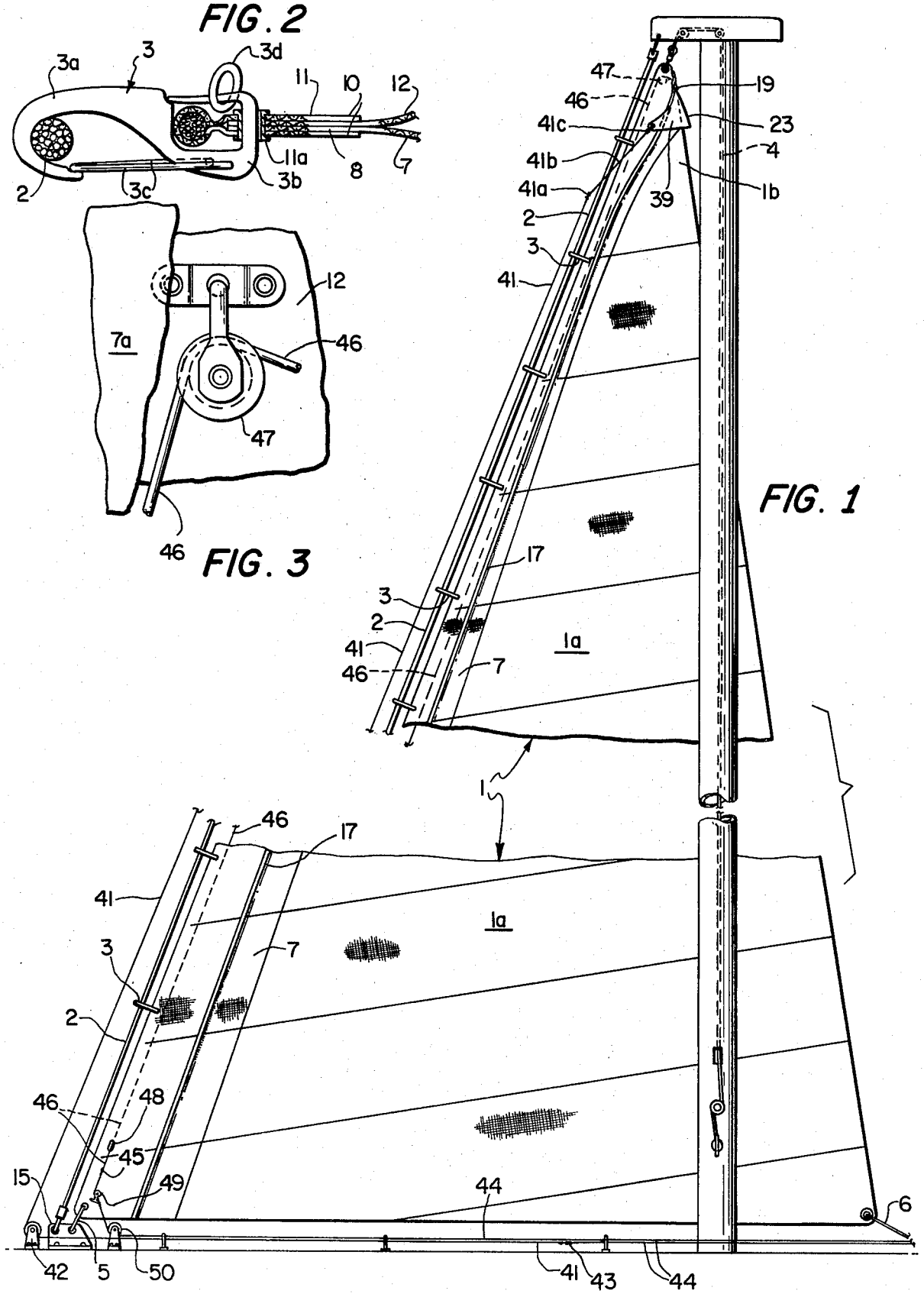
FIG. 1 is a semidiagrammatic side elevational view of a jibsail according to the invention, with the sail unfurled and set.
FIG. 2 is an enlarged fragmentary horizontal sectional view illustrating the manner in which the sail of FIG. 1 is attached to the headstay.
FIG. 3 is a fragmentary side elevational view of a portion of the head area of the sail of FIG. 1 showing one manner for establishing on the sail a turning point for the unfurling line.
Figure 9:
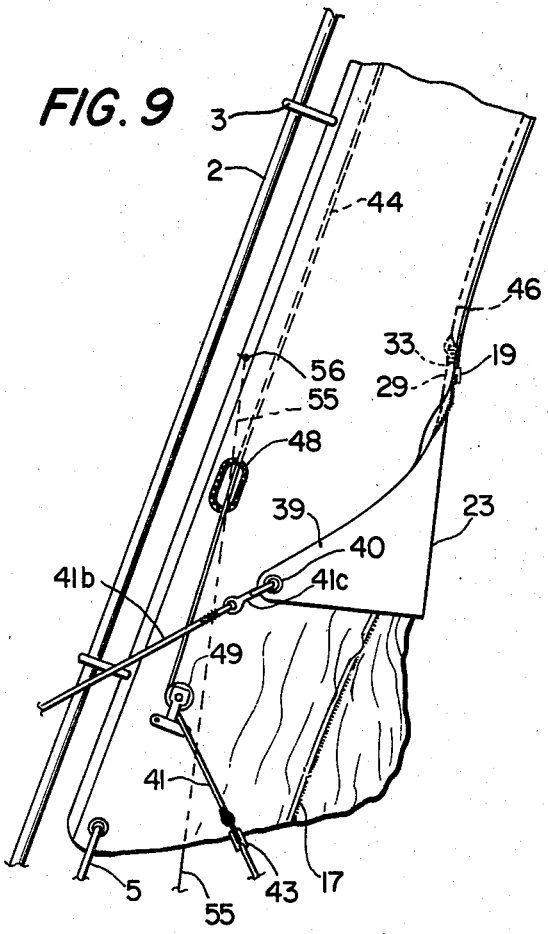
FIG. 9 is a fragmentary enlarged view showing the foot portion of the furled and bagged sail.

Considering FIGS. 1, 3, 4, 5 and 8–12, it will be seen that the sail includes a single furling line 41 one end of which is secured at 41*a*, FIG. 1, to two short lines 41*b* each attached by a snap hood 41*c*, FIG. 9, to the cringle 40 of a different one of the arms 39 of furler 23. Line 41 runs under a deck sheave 42 located immediately forward of bow fitting 15, thence aft along the deck under pad eyes or fair-leads to the cockpit area. The remaining end of furling line 41 is detachably connected by conventional sister hooks 43, FIG. 12, to an extension line 44 which returns forward along the deck and is permanently connected by a tapered and whipped splice 45, FIG. 12, to one end of the unfurling line 46, the other end of which is connected to cringle 33 of furler 23. The lengths of furling line 41, extension line 44 and unfurling line 46 are so chosen that, with the lines interconnected and the sail aloft and flying, furler 23 is in the uppermost position seen in FIG. 1, a loop of extension line 44 is at hand in the cockpit area while, when the furler is at the foot as seen in FIG. 8, sister hooks 43 are adjacent the foot, as seen in FIG. 9. The lengths of the furling and unfurling lines thus depend upon the size of the sail, and differences from boat to boat in the distance between the head stay and cockpit area can be accommodated by selecting the length of extension line 44. From its connection to extension line 44, unfurling line 46 extends (when the sail is aloft and flying) upwardly through the space between luff portions 7 and 12, over a sheave 47 and thence to the furler.

When the sail is aloft and flying, furler 23 is engaged over the leech with fastener element 17, 18 extending through runner 19 so that the fastener is closed over the leech above runner 19 and projecting nose portion 29 of furler 23 extends between the closed fastener and the leech. Sheave 47 is located between the reinforced head portion of the sail and added portion 7*a*, the sheave being secured, as by riveting, to the head portion as seen in FIG. 3. At the foot of the sail, when the sail is aloft and flying, unfurling line 46 exits from the space between luff portions 7, 12 via an opening 48, FIG. 1, and runs under a sheave 49 secured, as by riveting, to the outside of luff portion 7, the splice at 45 then advantageously being just above sheave 49. Extension line 44 then runs under a deck sheave 50. With the sail aloft and unfurled, line portions 41*b* form a bridle, each portion 41*b* extending over a different side of the sail, and the main portion of furling line 41 therefore extends just forward of headstay 2, generally as seen in FIG. 1. With the loop formed by extension line 44 being secured, as to a cleat (not shown) in the cockpit area, the combination of line portions 41*b* and line 41 is held in tension between sheave 42 and furler 23, the latter being secure because of its connection to unfurling line 46 and thus to sheave 47, and by engagement with the leech. Furling line 41, including the bridle formed by portions 41*b*, and extension line 44 are heavier and of greater strength than unfurling line 46. Thus, line 46 can be of relatively small diameter so as to present no significant deformation of the double luff of the sail when the sail is set.

As seen in FIG. 2, clip-on hanks 3 each include an integral metal body having a stay hook portion 3*a* and a luff hook portion 3*b*. The stay hook portion is dimensioned to receive headstay 2 and is releasably closed by a spring bail 3*c*. Luff hook portion 3*b* extends through cringle 11*a*, and then through a small retaining ring 3*d* on the starboard side of the sail, hook portion 3*b* being deformed to the closed position seen in FIG. 2 after being inserted through the cringle and ring.

Considering now the practice of the method of the invention by use of the sail system shown in FIGS. 1–12, assume that the sail has been attached to the headstay in conventional fashion, run up, and set as seen in FIG. 1, and that it is desired to furl the sail, as when sailing is finished or when the sail is to be changed. Before furling is commenced, furler 23 is in its uppermost position, arms 39 of the furler curving over fastener elements 17 and 18, respectively, and thence extending downwardly and forwardly over the outer surfaces of fabric portions 7*a* and 13, respectively, the furler remaining in that position, and under light tension applied by the furling and unfurling lines so long as extension line 44 is secured under tension at the cockpit. At this stage, nose portion 29 of the furler projects a short distance upwardly from runner 19 and beneath the closed upper end portion of the fastener. A greater portion of the furler, lying downwardly or in front of runner 19, embraces the leech of the sail with arms 39 exposed so that fastener elements 17, 18 run under arms 39 and curve over the furler behind arms 39 and enter runner 19. The sail is furled progressively from head to foot by pulling down on furling line 41. This is accomplished from the cockpit by grasping the looped portion of extension line 44 and pulling aft the end portion of line 44 which is connected to line 41. Since the combination of furling line 41, extension line 44, unfurling line 46 and travelling furler 23 extend as a closed loop, unfurling line 46 is pulled downwardly from sheave 47 as a result of downward travel of furler 23, so that what would otherwise be the slack in the furling line is drawn forwardly from the cockpit, under sheaves 50 and 49 and thence upwardly within the space between luff portions 7 and 12.

At the outset of furling, intermediate portion 22 of the travelling furler is engaged over the leech of the sail and is urged both downwardly and forwardly by the tension applied to arms 39 by the bridle lines. As the furler travels downwardly, it first traverses the aft portion of head area 1*b*, urging the material of that portion forwardly. As the downward travel of the furler progresses toward the foot of reinforced head area 1*b*, the furler forces the aft portion of the head area forwardly, carrying the juncture between the trailing edges of fabric portions 7*a*, 13 toward the leading edge of head area 1*b*. As a result, the aft portions of fabric portions 7*a*, 13 are turned inwardly, to commence progressive formation of a tubular bag, and the part of the head area 1*b* between the trailing edges of fabric portions 7*a*, 13 and the leech is folded into the bag as the bag is formed. Since runner 19 of the separable fastener is secured to furler 23, the runner travels with the furler, progressively joining fastener elements 17, 18 to close the fastener and secure the formed portion of the bag against opening. It is the portions of fabric portions 7*a*, 13 between fastener elements 17, 18 and the seam between the trailing edges of portions 7*a*, 13 and the sail which form the bag portion directly containing all of reinforced head area 1*b* aft of the trailing edges of portions 7*a*, 13, as will be clear from FIG. 10, and it will be noted that the fore portions of fabric portions 7*a*, 13 between the leading edge and fastener elements 17, 18 enclose not only the bag portion just mentioned but also the fore portion of reinforced head area 1*b*, i.e., that portion between the leading edge of the reinforced head area and the trailing edges of fabric portions 7*a*, 13.

As furler 23 progresses beyond the foot of reinforced head area 1*b*, it leaves fabric portion 13 and commences to force the aft portion of the main body 1*a* of the sail forwardly between those portions of added fabric portion 7 and sail portion 12 which lie between fastener elements 17, 18 and the juncture between trailing edge 9 of fabric portion 7 and the body of the sail. Since the intermediate portion 22 of the furler is engaged over the leech while flexible arms 39, held under tension by the act of pulling the furling line, embrace the aft portion of the sail, and since the furler moves along the material of the sail, the aft portion of the sail is not simply crumpled and stuffed forwardly. Rather, the furler coacts with added portion 7 and sail portion 12 to form the aft portion of the sail into a series of folds commencing at the trailing edge of portion 7 and progressing to the leech, much as the sail would be folded if "flaked" by hand.

While arms 39 of the furler lie outside of head portions 7*a*, 13 when the furler and fastener runner are in the uppermost positions seen in FIG. 1, pulling the furler downwardly by line 41 inherently causes the arms of the furler to move in advance of the lower end of the bag being formed, and the furler therefore acts not only to furl the sail but also to smoothly insert the furled sail material into the space between the now inwardly and forwardly extending aft portions of portions 7 and 12. Travelling downwardly with furler 23, fastener runner 19 progressively closes fastener elements 17 and 18. Such closing of the fastener secures the bag about the furled sail so that, when the furler has been pulled to its lowermost position, seen in FIG. 8, the entire sail has been furled and enclosed within a tubular bag which is secured against opening.

Since fastener elements 17, 18 extend along lines slightly nearer to the trailing edge of fabric portion 7 than to the leading edge of portion 7, the completed tubular bag includes an inner portion, which directly encloses the furled sail and is formed by those parts of portions 7 and 12 which extend between fastener elements 17, 18 on the one hand and the seam at trailing edge 9 on the other hand, and an outer portion defined by the parts of fabric portion 7 and sail portion 12 which extend forwardly from fastener elements 17 and 18, the inner bag portion being extended in tension by the enclosed sail material, the outer bag portion not being tensioned but fitting relatively snugly about the inner bag.

As furling of the sail proceeds, unfurling line 46 is pulled progressively downwardly within the tubular bag in a location immediately beneath the now closed fastener elements 17, 18 as seen in FIGS. 10 and 11. Since the unfurling line traverses sheave 47, which forms a turning point at the head of the sail, downward travel of the unfurling line within the tubular bag pulls extension line 44 upwardly into the bag along a path adjacent the leading edge of the sail, as seen in FIGS. 10 and 11. When furling has been completed, as seen in FIGS. 8 and 9, unfurling line 46 is completely housed within the tubular bag, extension line 44 is mainly housed in the bag but with the lower end thereof extending beyond opening 48, and furling line 41 is completely outside of the bag and on the deck. Accordingly, no lines external to the bag are aloft, and since the sister clips at 43 and the snap hooks 41*c* are exposed, furling line 44 can be disconnected and stowed. The sister hook to which line 41 is connected can then be connected to one of the snap hooks 41*c* of the bridle, furling line 41 then being secure on the deck because it is cleated in the cockpit area and still traverses sheave 42. Thus, the furled and bagged sail can be left aloft, with no free lines as impediments.

Alternatively, the furled and bagged sail can be lowered, detached from the headstay and stowed. In this connection, it will be noted that, commencing at the foot, the first clip-on hank 3 is spaced from the tack by a larger distance, typically 5 feet, the next is spaced a smaller distance above the first, typically 4 feet, and the remaining hanks are spaced along the luff tape at equal shorter distances, typically 3 feet. Such spacing of hanks 3 allows the furled and bagged sail to be lowered (after slacking the halyard) without first detaching the hanks from stay 2, the bagged sail folding generally in accordian fashion and all of the hanks then being more or less side-by-side and on the foot end portion of the headstay. A tie cord 55 has one end secured to the leading edge of the sail, as by tying through a spur cringle at 56, FIG. 9, spaced above window 48 and below the first clip-on hank 3, cord 55 simply hanging free on the starboard side of the luff tape when the sail is aloft. When the bagged sail has been lowered, cord 55 is run through all of the rings 3*d* on the clip-hanks, then pulled taut to force the hanks toward each other, and then tied to itself near cringle 56, securing the bagged sail in its generally accordian-folded condition and providing a handle by which the sail can be carried. The clip-on hanks are then detached from the headstay and the sail stowed.

When, with the sail furled and bagged and aloft but with lines 41, 41*b* still connected, as seen in FIG. 8, it is desired to unfurl the sail, the loop presented by the furling line is manipulated to pull extension line 44 downwardly out of the tubular bag, thus pulling furling line 46 upwardly over sheeve 47 and thence downwardly within the double luff, and therefore pulling furler 23 upwardly along the leech. As the furler moves upwardly, runner 19 progressively disengages fastener elements 17 and 18 so as to open the tubular bag and release the sail. As furler 23 moves upwardly, and extension line 44 is withdrawn downwardly from the space between luff portions 7 and 12, the end of the furling line which is attached to the bridle formed by portions 41*b* is pulled upwardly along a path just forward of headstay 2. When the furler again reaches the head position seen in FIG. 1, the tubular bag which had contained the sail is completely open, the sail is free to fly, and unfurling line 46 has been returned to the space between luff portions 7, 12.

THE MAINSAIL EMBODIMENT OF FIGS. 13–17

In this embodiment, mainsail 101 is of a double luff type fully described in my copending application Ser. No. 139,105 and comprises a hollow-leech loose-footed mainsail body 101*a*, a reinforced head portion 101*b* and a headboard 101*c*. The fabric of main body 101*a* extends to the head, terminating at the upper edge of the headboard. An additional luff portion 107 overlies the port side of sail body 101*a* and has its leading edge 108 coincident with the entire leading edge of the sail and its trailing edge 109 sewed to the sail from a point 109*a*, spaced slightly below the foot of reinforced head portion 101*b*, to the foot of the sail. A portion 107*a* of portion 107 extends upwardly from the location of free horizontal edge 109*b*. The trailing edge of portion 107*a* is at first parallel to the luff, then curves upwardly and aft to the leech of reinforced portion 101*b* in a location, e.g., 12 in. below the bottom of headboard 101*c*, then following the leech, and then departing from the leech along a straight vertical line spaced, e.g., 1.5 in. aft of the leech, as best seen in FIG. 14.

A second additional portion of flexible sheet material 112, FIG. 15, overlies the starboard side of sail 101, the leading edge 186 of portion 112 extending along the entire leading edge of sail 101, the trailing edge of portion 112 extending along a line spaced forwardly from the trailing edge of portion 107, below edge 109*b*, by a distance slightly less than half the width of portion 107. Both luff portions 107 and 112 can be of ultra-violet resistant cover material. Above edge 109*b*, portion 112 extends upwardly over head area 101*b* and has the same plan configuration and dimensions as does luff added portion 107*a*.

One tape 117 of a conventional zipper type slide fastener extends over the outer surface of portion 107 and is sewed thereto, a weather-resistant cover strip 117*a* being secured over the tape by the same stitching. The second tape 118 of the slide fastener is sandwiched between the trailing edge 187 of portion 112 and the fabric of main body 101*a* of the sail, and trailing edge 187, tape 118 and the sail cloth are stitched together throughout the entire length of tape 118 below edge 109*b*. Above edge 109*b*, tapes 117, 118 follow and are sewed to the respective trailing edges of portion 107*a* and that part of portion 112 which extends across reinforced head portion 101*b*, but are not sewed to the sail itself. Thus, from edge 109*b* upwardly, the trailing edges of the added fabric portions 107*a*, 112*a* are not secured to the sail itself. The extreme upper ends of tapes 117 and 118 are, however, turned forwardly to overlap the sail, are sewed thereto with the teeth of the fastener permanently engaged (so the upper end of the fastener is permanantly closed) and are clamped between the two plates 185 of the headbard. Both portions 107*a* and 112*a* are stitched to reinforced head portion 101*b* along a line 100 commencing at the head and extending downwardly generally parallel to but spaced forwardly from the leech to the location where tapes 117, 118 cross the leech, at which point line 100 curves to slant downwardly and forwardly parallel to tapes 117, 118 until, after crossing the foot of the reinforced head portion, line 100 curves forwardly to cross the luff tape.

The bight of luff tape 111 is sewed to a relatively heavy boltrope 188, FIG. 15, which extends along the entire leading edge of the sail. A plurality of cringles 189 are applied to tape 111 at points spaced along the tape immediately adjacent rope 188. A plurality of slides 190 are spaced along rope 188, each slide being secured to the sail by flat waxed nylon lacing tape 191 laced through one of the cringles 189 and the opening 192 in the flange 193 of the slide. Slides 190 are conventional and include an elongated forward portion 194 slidably engageable in a longitudinal slot 195 in the mast 148.

Halyard 104 is connected conventionally to headboard 101*c*, run upwardly and over a sheave in exit box 212, thence downwardly through the mast, exiting via exit box 213 to winch 214, and being secured on cleat 215. The boom is advantageously equipped with a boom topping lift line 216 connected to the free end of the boom and running to the masthead assembly, thence downwardly through the mast to exit via exit box 217 to be secured by cleat 218.

The tack of sail 101 is hooked to boom mount 105 in conventional fashion. Boom 200 is a conventional hollow boom, connected to mount 105 by a conventional universal joint, and equipped with a longitudinally extending upper track 201, FIGS. 16 and 18, slidably retaining a clew slug 202. Clew slug 202 is permanently secured to the clew cringle 204 by lacing tape 205. The boom is equipped with an outhaul sheave 207, FIG. 13, and an outhaul line 206 extends from a cleat 209 near the mast, into the boom via an access window, under sheave 207 and to the clew where the line is attached to cringle 204 by a snap shackle 206*a*. It will be seen that clew slug 202 is permanently attached to the sail, it being understood that the slug can be removed from the end of track 201 nearer the mast in usual fashion when the sail is to be removed.

Also permanently secured to the sail at the clew cringle is a reefing sheave 219, FIGS. 16 and 18, to accommodate a reefing line 220. Sheave 219 can comprise a generally U-shaped body with the wheel shaft extending between and carried by the end portions of the U, the sheave being secured by a tape 221 passing through cringle 204, one end portion of the tape being looped around the bead of the U of the sheave body and sewed to the tape, the other end of the tape being secured to a stop ring 223 of larger diameter than the inner diameter of the cringle. Reefing line 220 has one end secured to a cleat 222 on the boom adjacent the mast, runs through a tabling 220*a* along the foot of the sail to a point adjacent the clew, thence under sheave 219 and upwardly along the leech to the first leech reefing cringle, thence downwardly on the opposite side of the sail to be secured to the stop ring 223 which retains sheave 219. If provision is to be made for additional reef points, an additional reefing line (not shown) is provided for each additional reef point, the additional reefing line or lines all extending through the tabling 220*a* and the single sheave 219 being replaced by a multiple sheave (not shown).

Travelling furler 123 can be constructed as described with reference to FIGS. 6 and 7 and thus has a flexible body comprising an intermediate portion 124, FIG. 14, to engage over the leech, two arms 125, and a rearwardly projecting nose portion 126 equipped with a cringle 127. Runner 119 of the slide fastener is lashed to the center line of nose portion 126 immediately in front of cringle 127. In this embodiment, two furling lines 141 are employed, one end of each furling line being attached to the cringle at the tip of a different one of furler arms 125. When the sail is set and flying, as seen in FIG. 13, furler 123 is at the head and furling lines 141 extend downwardly beyond the foot of the sail, around a sheave 150 fixed to the mast and thence upwardly, the remaining ends of lines 141 being secured to one sister hook at 142. Unfurling line 146 has one end attached to cringle 127 of nose portion 126 of the furler, the nose portion projecting beneath the permanently closed upper end portions of fastener tapes 117, 118 so that this end of line 146 is enclosed by fabric portions 107*a* and 112*a*. From the furler, unfurling line 146 extends upwardly over a sheave 147 secured, as by riveting, to the reinforced head portion of the sail. From sheave 147, line 146 extends downwardly and over a second sheave 147*a*, thence downwardly between luff portion 107 and main sail body 101*a* adjacent the leading edge of the sail. As best seen in FIG. 14, sheave 147 is located substantially below the top of headboard 101*c* and between the trailing edge of the headboard and the leech, while sheave 147*a* is located immediately below the headboard and adjacent the luff tape, both of the sheaves lying between fabric portion 107*a* and the reinforced head portion 101*b* of the sail. Thus, sheave 147 provides a turning point on the sail for the unfurling line, and sheave 147*a* serves to position the line to run along a path immediately adjacent the luff tape. From sheave 147*a*, the unfurling line extends downwardly to the foot of the sail, emerging through the open end of the double luff. The free end of the unfurling line is tied at 142, FIG. 13, to the joined ends of the two furling lines 141. Considering FIG. 13, it will be seen that the wheel of sheave 150 turns about an axis at right angles to the axis of rotation of sheave 147*a* and is so located that, when the combination of lines 141, 146 is under tension over the two sheaves, the portion of the unfurling line below sheave 147 is substantially parallel to the leading edge of the sail. The lengths of lines 141 and 146, the distance between cringle 127 and the cringles at the free ends of furler arms 125, and the location of sheaves 147, 147*a* and 150 are so chosen that, when the sail is fully aloft and flying, so that furler 123 is in its uppermost position, as seen in FIG. 14, and the furling lines are passed around sheave 150 and upwardly, there is then some slack in the combination of the furling lines and unfurling line between sheaves 150 and 147*a*.

As best seen in FIG. 14, furler 123 is so engaged with the leech at the head of the sail that arms 125 extend downwardly and forwardly each on a different side of the sail and the slide fastener tapes run upwardly one under each arm 125 to curve over the furler and enter the mouth of runner 119 in locations immediately adjacent the trailing portions of arms 125.

To commence furling the sail, the topping lift is snugged up, the outhaul line is released from cleat 209 and furling lines 141 are grasped immediately above sheave 150, between the sheave and the connection to the unfurling line, and pulled upwardly around that sheave. As a result, the main portions of lines 141 are pulled downwardly causing furler 123 to move downwardly and both furl the sail and concurrently form and close the tubular bag about the sail in the general manner described with reference to the embodiment of FIGS. 1–12, the furled and bagged sail therefore being as seen in FIG. 17. As furling and bagging of the sail proceeds, the unfurling line is pulled downwardly into the area where the bag is being formed and closed by the furler and runner 119, and furling lines 141 are concurrently pulled upwardly into the space within the double luff and into the bag. Accordingly, in the fully furled and bagged sail, unfurling line 146 extends beneath the now-closed fastener tapes 117, 118 and furling lines 141 extend adjacent the trailing edge of the luff tape, as will be clear from FIG. 17. Furled and bagged, the sail can be left aloft. A double jam cleat 151 is provided on the mast between sheave 150 and the boom to secure the furling lines in tension. A second single jam cleat 152 is secured, as by riveting, to one of the luff portions, e.g., to luff portion 101*a*, FIG. 19, adjacent the luff tape so that unfurling line 146 can be secured in tension between cleat 152 and sheave 147*a*.

When the sail is to be unfurled to fly, the furling and unfurling lines are first released from the respective jam cleats and the furling lines are then grasped on the side of sheave 150 opposite the unfurling line and pulled upwardly, causing the unfurling line to be pulled downwardly from the bag and furler 123 therefore to be pulled upwardly along the leech, with the result that runner 119 progressively disengages fastener tapes 117 and 118, opens the tubular bag and releases the sail. When furler 123 has been pulled back to the uppermost position, as seen in FIG. 13, unfurling line 146 is secured under tension in cleat 152, FIG. 19, and the portions of lines 141 still extending upwardly from sheave 150 are then engaged in jam cleat 151. The outhaul line is then pulled to return clew slug 202 to its proper outer position, and the outhaul line is again secured under tension to cleat 209. The topping lift is then eased.

When, with the sail fully aloft and flying, it is desired to reef the sail, the topping cleft is snugged up, the halyard is slacked and the luff reefed to the first reef point by manually grasping the luff and pulling down until the luff reef point is at hand. When the luff reef point has been secured, the halyard is tightened and the outhaul line is then slacked enough to allow slug 202 to move along the boom toward the mast until sheave 219 occupies that position which will assure correct outhaul tension when reefing is completed, that position having been previously marked on the outhaul line (as by whipping a colored thread through the line) and the marked point on the line being, e.g., at cleat 209 when the line is properly slacked for reefing. Reefing is then completed by pulling reefing line 220, causing the line to travel downwardly about sheave 219 until the first leech reef point arrives at the boom, the reefing line then being secured again to cleat 222 and the topping line then eased. The furling and unfurling lines are then manipulated to reestablish tension in both the furling lines and the unfurling line.

What is claimed is:

1. The method for furling a working sail while the sail is aloft on a sailboat having a cockpit, comprising providing flexible sheet material along the sail from head to foot;

positioning a travelling furler at the head and engaged over the leech with the furler having connected thereto furling line means and unfurling line means;

interconnecting the ends of the furling line means and unfurling line means most distant from the furler;

pulling the furling line means to cause the travelling furler to move downwardly and progressively furl the sail from leech to luff and form the flexible sheet material into a tubular bag enclosing the furled sail substantially from head to foot;

and simultaneously causing the unfurling line means and a portion of the furling line means to be pulled into stowed positions in which the line means extend lengthwise of and within the tubular bag.

2. The method according to claim 1 wherein the sail comprises two luff portions secured together along their leading edges and along their trailing edges but free and unattached from head to foot between the leading and trailing edges, and wherein the step of pulling the furling line means causes the unfurling line means to be pulled from a position in which the unfurling line means extends from foot to head through the space between the two luff portions to a second position in which a major portion of the unfurling line means extends from head to foot within the tubular bag but outside of the space between the two luff portions.

3. The method according to claim 1 wherein the sail is a headsail, and the step of pulling the furling line means is carried out from the cockpit area.

4. The method according to claim 3, wherein the furling line means is detachably secured at one end to the travelling furler and detachably secured at the other end to the end of the unfurling line means most distant from the travelling furler; and the method further comprises detaching the furling line means from the furler and the unfurling line means after the sail has been furled and bagged.

5. The method according to claim 4, wherein the unfurling line means includes an extension line detachably connected to the end of the furling line means most distant from the furler; and the step of detaching said portion of the furling line means is accomplished by detaching both ends of the furling line means, the method further comprising reattaching the two ends of the furling line means to each other.

6. In a working sail capable of being remotely furled and bagged while aloft on a sailboat having a cockpit, the combination of flexible sheet material extending along the leading portion of the sail substantially from head to foot;

elongated flexible fastener means comprising two elongated flexible fastener elements, each of the flexible fastener elements being secured to said flexible sheet material along a different linear portion thereof extending substantially from head to foot, and runner means operatively associated with the elongated flexible fastener elements to progressively close the fastener means when the runner means is moved from head to foot and progressively open the fastener means when the runner means is moved from foot to head, the lateral extent of said flexible sheet material between said different linear portions being adequate to form a tubular bag capable of containing the sail when the sail is furled from leech to luff, head end portions of the elongated fastener elements being permanently closed to provide at the head of the sail an initial bag portion;

means for furling the sail comprising a travelling furler engaged over the aft portion of the sail and including a leading portion facing the foot and a trailing portion facing the head, said trailing portion extending beneath the elongated fastener elements and into said initial bag portion when, with the sail fully aloft and flying, the furler is in its uppermost position;

means for operating the furler and fastener means remotely comprising furling line means having one end connected to the combination of the furler and the runner means, and unfurling line means having one end portion extending within said initial bag portion and connected to said trailing portion of the furler; and means interconnecting the other ends of the furling line means and the unfurling line means, pulling downwardly on the furling line means being effective to move the combination of the furler and runner means downwardly to progressively furl the sail, enclose the furled sail in the tubular bag and close the fastener means to secure the bag against opening, at least the unfurling line means being substantially enclosed in the tubular bag when furling is completed, pulling downwardly on the unfurling line means after furling being effective to return the furler and runner means to the head to release the sail and return the furling line means and unfurling means to the original positions occupied when the furler was at the head with the sail flying.

7. The combination defined in claim 6, wherein said flexible sheet material comprises two luff portions each extending substantially from the head of the sail to the foot of the sail and each including a leading edge, and a trailing edge, the leading edges being secured along the leading edge of the sail and the trailing edges each being secured along a line spaced aft from the leading edge of the sail, the two luff portions being free and unattached throughout the space between the leading and trailing edges from head to foot;

the unfurling line means extending from the furler over a turning point on the head of the sail and, when the sail is fully aloft and flying, from the turning point downwardly through the space between the two luff portions.

8. The combination defined in claim 7, wherein the sail is a headsail;

said means interconnecting the other ends of the furling line means and the unfurling means includes an extension line forming part of the unfurling line means and having one end connected to the furling line means; and the lengths of the furling line means, unfurling line means and extension line are such that, for all operative positions of the furler on the sail, a looped portion of one of the extension line and the furling line means is available in the cockpit area.

9. The combination defined in claim 8, wherein the travelling furler comprises an intermediate portion engageable over the leech, and two arms extending from the intermediate portion each on a different side of the sail; and the furling line means includes two bridle portions each connected at one end to a different arm of the furler, and a single line portion connected to the other ends of the bridle portions.

10. The combination defined in claim 9, wherein the bridle portions and the single line portion of the furling line means and the extension line are of relatively larger diameter line of greater strength;

the unfurling line means includes a single line which extends through the space between the two luff portions when the sail is aloft and flying; and the single line of the unfurling line means is of relatively smaller diameter.

11. The combination defined in claim 9, wherein the two bridle line portions are each detachably connected to a different one of the furler arms; and the single line portion of the furling line means is detachably connected to the extension line.

12. The combination defined in claim 11, wherein the single line portion of the furling line means and the extension line are interconnected by sister hooks.

13. The combination defined in claim 6, wherein the trailing portion of the furler is equipped with a cringle;

the unfurling line means includes a portion extending as a single line; and the single line of the unfurling means is connected to the cringle of the trailing portion of the furler.

14. The combination defined in claim 6, wherein the unfurling line means includes a portion extending as a single line;

the combination further comprises means secured to the head portion of the sail and constituting a turning point; and the single line of the unfurling line means extends from said trailing portion of the furler, over the turning point and thence downwardly.

15. The combination defined in claim 14, wherein said means secured to the head portion of the sail is a sheave.

16. The combination defined in claim 14 and further comprising means secured to the sail adjacent the tack and providing a turning point about which a line extending from the head can be run and thence led aft along the deck.

17. The combination defined in claim 16, wherein said means secured to the sail adjacent the tack is a sheave.

18. The combination defined in claim 7, wherein one of said two luff portions is provided with an aperture adjacent the tack via which a line can exit from the space between the two luff portions.

19. The combination defined in claim 18 and further comprising a sheave secured to said one luff portion in a location below said aperture and on the outer side of the luff portion.

20. The combination defined in claim 7, wherein the sail is a mainsail;

the travelling furler comprises an intermediate portion engageable over the leech, and two arms extending from the intermediate portion each on a different side of the sail;

the furling line means comprises two lines each having one end connected to a different arm of the furler, the two lines of the furling line means extending downwardly each on a different side of the sail, when the sail is fully aloft and flying, to a point below the foot, the other ends of the two lines of the furling line means being connected to the end of the unfurling line means most distant from the furler.

21. The combination defined in claim 20, wherein the sail is equipped with a leech cringle defining a leech reefing point, the combination further comprising a sheave secured to the sail at the clew; and a reefing line running to the clew, around the sheave, thence upwardly along the leech, through the leech cringle and downwardly along the other side of the leech to the clew and there being secured to the sail.

22. The combination defined in claim 21 and further comprising a clew traveller constructed and arranged to cooperate with a boom track; and means securing the traveller to the clew.

23. The combination defined in claim 20 and further comprising means secured to the sail at the tack by which the unfurling line means can be secured in tension to the sail when the furler is at the head.

24. The combination defined in claim 23, wherein said means secured to the sail at the tack is a jam cleat disposed within the space between the two luff portions.

25. The combination defined in claim 6, wherein the sail is a headsail and comprises a luff tape equipped with a plurality of cringles spaced along the leading edge of the sail;

the combination further comprising a plurality of hanks each secured to a different one of the cringles along the luff tape and each comprising a first portion extending through the cringle and securing the hank, and a second portion constructed and arranged to be clipped to the headstay; and a plurality of retaining rings each carried by said first portion of a different one of the hanks whereby, when the sail has been furled and bagged and then lowered, but while the hanks are still clipped to the stay, a tie cord can be run through the retaining rings to secure the sail preparatory to removing the hanks from the stay.

26. The combination defined in claim 25, wherein said flexible sheet material comprises two luff portions each extending substantially from the head of the sail to the foot of the sail and each including a leading edge, and a trailing edge, the leading edges being secured along the leading edge of the sail and the trailing edges being secured along a line spaced aft from the leading edge of the sail, the two luff portions being free and unattached throughout the space between the leading and trailing edges from head to foot;

the unfurling line means extending from the furler over a turning point on the head of the sail and, when the sail is fully aloft and flying, from the turning point downwardly through the space between the two luff portions;

one of the two luff portions is provided with an aperture adjacent the tack via which a line can exit from the space between the two luff portions;

the combination further comprising a tie cord secured to the sail adjacent the leading edge and above said aperture, the tie cord being so secured as to normally depend along the outer surface of the other of the two luff portions.

* * * * *